US006634817B2

(12) United States Patent
Serizawa

(10) Patent No.: US 6,634,817 B2
(45) Date of Patent: Oct. 21, 2003

(54) IMAGE FORMING APPARATUS

(75) Inventor: Yoji Serizawa, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 88 days.

(21) Appl. No.: 09/739,901

(22) Filed: Dec. 20, 2000

(65) Prior Publication Data

US 2001/0005457 A1 Jun. 28, 2001

(30) Foreign Application Priority Data

Dec. 22, 1999 (JP) ..... 11-365254
Dec. 14, 2000 (JP) ..... 2000-380613

(51) Int. Cl.[7] ..... B41J 11/44

(52) U.S. Cl. ..... 400/582; 400/61; 400/70; 400/76; 400/613

(58) Field of Search ..... 400/582, 613, 400/76, 692, 70, 62

(56) References Cited

U.S. PATENT DOCUMENTS 4,962,430 A * 10/1990 Hiroki et al. ..... 358/296
5,448,375 A * 9/1995 Cooper et al. ..... 358/403
5,899,614 A * 5/1999 Maeda et al. ..... 400/62
5,933,676 A * 8/1999 Ohno ..... 399/8
6,169,567 B1 * 1/2001 Hashimoto et al. ..... 347/262
6,188,852 B1 * 2/2001 Ojima et al. ..... 399/25
6,280,105 B1 * 8/2001 Iida ..... 400/74

* cited by examiner

*Primary Examiner*—Charles H. Nolan, Jr.
(74) *Attorney, Agent, or Firm*—Fitzpatrick, Cella, Harper & Scinto

(57) ABSTRACT

In an image forming apparatus mountable a detachable unit mounting a memory in a main body of the apparatus, a memory-access-reservation control unit for accepting a request of an access with respect to a nonvolatile memory provided in a process cartridge in which a photosensitive drum, a toner and the like are integrated is provided in an engine control unit. When there is a request of an access with respect to the nonvolatile memory from a printer controller, the memory-access-reservation control unit accesses the nonvolatile memory in accordance with the request of the access. Upon completion of the access, the fact is notified to the printer controller. In response to the notification, the printer controller requests transmission of read information or confirms that a writing operation has been normally ended, by communicating with the engine control unit.

25 Claims, 18 Drawing Sheets

FIG.4A

| Bit | CONTENTS |
|---|---|
| 1st bit | 0 |
| 2nd bit | READ RESERVATION COMMAND CODE 2^5 |
| 3rd bit | READ RESERVATION COMMAND CODE 2^4 |
| 4th bit | READ RESERVATION COMMAND CODE 2^3 |
| 5th bit | READ RESERVATION COMMAND CODE 2^2 |
| 6th bit | READ RESERVATION COMMAND CODE 2^1 |
| 7th bit | READ RESERVATION COMMAND CODE 2^0 |
| 8th bit | READ MEMORY AREA CODE 2^7 |
| 9th bit | READ MEMORY AREA CODE 2^6 |
| 10th bit | READ MEMORY AREA CODE 2^5 |
| 11th bit | READ MEMORY AREA CODE 2^4 |
| 12th bit | READ MEMORY AREA CODE 2^3 |
| 13th bit | READ MEMORY AREA CODE 2^2 |
| 14th bit | READ MEMORY AREA CODE 2^1 |
| 15th bit | READ MEMORY AREA CODE 2^0 |
| 16th bit | ODD PARITY |

FIG.4B

| 8~15th Bit CODE | CONTENTS |
|---|---|
| 00h | CONTENTS OF NONVOLATILE-MEMORY ADDRESS 00h |
| 01h | CONTENTS OF NONVOLATILE-MEMORY ADDRESS 01h |
| 02h | CONTENTS OF NONVOLATILE-MEMORY ADDRESS 02h |
| 03h | CONTENTS OF NONVOLATILE-MEMORY ADDRESS 03h |
| 04h | CONTENTS OF NONVOLATILE-MEMORY ADDRESS 04h |
| 05h | CONTENTS OF NONVOLATILE-MEMORY ADDRESS 05h |
| 06h | CONTENTS OF NONVOLATILE-MEMORY ADDRESS 06h |
| 07h | CONTENTS OF NONVOLATILE-MEMORY ADDRESS 07h |
| ~ | ~ |
| FEh | CONTENTS OF NONVOLATILE-MEMORY ADDRESS FEh |
| FFh | CONTENTS OF NONVOLATILE-MEMORY ADDRESS FFh |

FIG.4C

| Bit | CONTENTS |
|---|---|
| 1st bit | 0 |
| 2nd bit | MEMORY ACCESS STATE CODE 2^2 |
| 3rd bit | MEMORY ACCESS STATE CODE 2^1 |
| 4th bit | MEMORY ACCESS STATE CODE 2^0 |
| 5th bit | unknown |
| 6th bit | unknown |
| 7th bit | unknown |
| 8th bit | READ MEMORY AREA CODE 2^7 |
| 9th bit | READ MEMORY AREA CODE 2^6 |
| 10th bit | READ MEMORY AREA CODE 2^5 |
| 11th bit | READ MEMORY AREA CODE 2^4 |
| 12th bit | READ MEMORY AREA CODE 2^3 |
| 13th bit | READ MEMORY AREA CODE 2^2 |
| 14th bit | READ MEMORY AREA CODE 2^1 |
| 15th bit | READ MEMORY AREA CODE 2^0 |
| 16th bit | ODD PARITY |

FIG.4D

| 2nd bit | 3rd bit | 4th bit | CONTENTS |
|---|---|---|---|
| 0 | 0 | 0 | DATA ACCESSIBLE |
| 0 | 0 | 1 | IN READING FROM MEMORY |
| 0 | 1 | 0 | IN WRITING INTO MEMORY |

FIG.5A

| Bit | CONTENTS |
|---|---|
| 1st bit | 0 |
| 2nd bit | CHANGE IN STS1 STATE PRESENT |
| 3rd bit | unknown |
| 4th bit | unknown |
| 5th bit | unknown |
| 6th bit | unknown |
| 7th bit | unknown |
| 8th bit | unknown |
| 9th bit | unknown |
| 10th bit | unknown |
| 11th bit | unknown |
| 12th bit | unknown |
| 13th bit | unknown |
| 14th bit | unknown |
| 15th bit | unknown |
| 16th bit | ODD PARITY |

FIG.5B

| Bit | CONTENTS |
|---|---|
| 1st bit | 0 |
| 2nd bit | STS2 REQUEST COMMAND CODE 2^13 |
| 3rd bit | STS2 REQUEST COMMAND CODE 2^12 |
| 4th bit | STS2 REQUEST COMMAND CODE 2^11 |
| 5th bit | STS2 REQUEST COMMAND CODE 2^10 |
| 6th bit | STS2 REQUEST COMMAND CODE 2^9 |
| 7th bit | STS2 REQUEST COMMAND CODE 2^8 |
| 8th bit | STS2 REQUEST COMMAND CODE 2^7 |
| 9th bit | STS2 REQUEST COMMAND CODE 2^6 |
| 10th bit | STS2 REQUEST COMMAND CODE 2^5 |
| 11th bit | STS2 REQUEST COMMAND CODE 2^4 |
| 12th bit | STS2 REQUEST COMMAND CODE 2^3 |
| 13th bit | STS2 REQUEST COMMAND CODE 2^2 |
| 14th bit | STS2 REQUEST COMMAND CODE 2^1 |
| 15th bit | STS2 REQUEST COMMAND CODE 2^0 |
| 16th bit | ODD PARITY |

FIG.5C

| Bit | CONTENTS |
|---|---|
| 1st bit | NONVOLATILE-MEMORY ADDRESS 00h DATA REQUEST COMMAND 2^14 |
| 2nd bit | NONVOLATILE-MEMORY ADDRESS 00h DATA REQUEST COMMAND 2^13 |
| 3rd bit | NONVOLATILE-MEMORY ADDRESS 00h DATA REQUEST COMMAND 2^12 |
| 4th bit | NONVOLATILE-MEMORY ADDRESS 00h DATA REQUEST COMMAND 2^11 |
| 5th bit | NONVOLATILE-MEMORY ADDRESS 00h DATA REQUEST COMMAND 2^10 |
| 6th bit | NONVOLATILE-MEMORY ADDRESS 00h DATA REQUEST COMMAND 2^9 |
| 7th bit | NONVOLATILE-MEMORY ADDRESS 00h DATA REQUEST COMMAND 2^8 |
| 8th bit | NONVOLATILE-MEMORY ADDRESS 00h DATA REQUEST COMMAND 2^7 |
| 9th bit | NONVOLATILE-MEMORY ADDRESS 00h DATA REQUEST COMMAND 2^6 |
| 10th bit | NONVOLATILE-MEMORY ADDRESS 00h DATA REQUEST COMMAND 2^5 |
| 11th bit | NONVOLATILE-MEMORY ADDRESS 00h DATA REQUEST COMMAND 2^4 |
| 12th bit | NONVOLATILE-MEMORY ADDRESS 00h DATA REQUEST COMMAND 2^3 |
| 13th bit | NONVOLATILE-MEMORY ADDRESS 00h DATA REQUEST COMMAND 2^2 |
| 14th bit | NONVOLATILE-MEMORY ADDRESS 00h DATA REQUEST COMMAND 2^1 |
| 15th bit | NONVOLATILE-MEMORY ADDRESS 00h DATA REQUEST COMMAND 2^0 |
| 16th bit | ODD PARITY |

FIG.5D

| Bit | CONTENTS |
|---|---|
| 1st bit | 0 |
| 2nd bit | NONVOLATILE-MEMORY ADDRESS 00h DATA 2^14 |
| 3rd bit | NONVOLATILE-MEMORY ADDRESS 00h DATA 2^13 |
| 4th bit | NONVOLATILE-MEMORY ADDRESS 00h DATA 2^12 |
| 5th bit | NONVOLATILE-MEMORY ADDRESS 00h DATA 2^11 |
| 6th bit | NONVOLATILE-MEMORY ADDRESS 00h DATA 2^10 |
| 7th bit | NONVOLATILE-MEMORY ADDRESS 00h DATA 2^9 |
| 8th bit | NONVOLATILE-MEMORY ADDRESS 00h DATA 2^8 |
| 9th bit | NONVOLATILE-MEMORY ADDRESS 00h DATA 2^7 |
| 10th bit | NONVOLATILE-MEMORY ADDRESS 00h DATA 2^6 |
| 11th bit | NONVOLATILE-MEMORY ADDRESS 00h DATA 2^5 |
| 12th bit | NONVOLATILE-MEMORY ADDRESS 00h DATA 2^4 |
| 13th bit | NONVOLATILE-MEMORY ADDRESS 00h DATA 2^3 |
| 14th bit | NONVOLATILE-MEMORY ADDRESS 00h DATA 2^2 |
| 15th bit | NONVOLATILE-MEMORY ADDRESS 00h DATA 2^1 |
| 16th bit | ODD PARITY |

FIG.7

| 2nd bit | 3rd bit | 4th bit | CONTENTS |
|---|---|---|---|
| 0 | 0 | 0 | DATA ACCESSIBLE |
| 0 | 0 | 1 | IN READING FROM MEMORY |
| 0 | 1 | 0 | IN WRITING INTO MEMORY |
| ∫ | ∫ | ∫ | ∫ |
| 1 | 1 | 1 | IN ACCESS BY ENGINE |

FIG.12A

| Bit | CONTENTS |
|---|---|
| 1st bit | 0 |
| 2nd bit | WRITE RESERVATION COMMAND CODE 2^5 |
| 3rd bit | WRITE RESERVATION COMMAND CODE 2^4 |
| 4th bit | WRITE RESERVATION COMMAND CODE 2^3 |
| 5th bit | WRITE RESERVATION COMMAND CODE 2^2 |
| 6th bit | WRITE RESERVATION COMMAND CODE 2^1 |
| 7th bit | WRITE RESERVATION COMMAND CODE 2^0 |
| 8th bit | WRITE MEMORY AREA CODE 2^7 |
| 9th bit | WRITE MEMORY AREA CODE 2^6 |
| 10th bit | WRITE MEMORY AREA CODE 2^5 |
| 11th bit | WRITE MEMORY AREA CODE 2^4 |
| 12th bit | WRITE MEMORY AREA CODE 2^3 |
| 13th bit | WRITE MEMORY AREA CODE 2^2 |
| 14th bit | WRITE MEMORY AREA CODE 2^1 |
| 15th bit | WRITE MEMORY AREA CODE 2^0 |
| 16th bit | ODD PARITY |

FIG.12B

| Bit | CONTENTS |
|---|---|
| 1st bit | 0 |
| 2nd bit | WRITING DATA 2^7 |
| 3rd bit | WRITING DATA 2^6 |
| 4th bit | WRITING DATA 2^5 |
| 5th bit | WRITING DATA 2^4 |
| 6th bit | WRITING DATA 2^3 |
| 7th bit | WRITING DATA 2^2 |
| 8th bit | WRITING DATA 2^1 |
| 9th bit | WRITING DATA 2^0 |
| 10th bit | unknown |
| 11th bit | unknown |
| 12th bit | unknown |
| 13th bit | unknown |
| 14th bit | unknown |
| 15th bit | unknown |
| 16th bit | ODD PARITY |

IMAGE FORMING APPARATUS

BACKGROUND OF THE INVENTION

1. Field of the Invention

The present invention relates to an image forming apparatus, and more particularly, to an image forming apparatus which can use a functional unit that can be detachably mounted in a main body of the image forming apparatus and that includes a nonvolatile memory capable of communicating with the main body of the image forming apparatus.

2. Description of the Related Art

FIG. 9 is a cross-sectional view illustrating the configuration of an electrophotographic printer, serving as an image forming apparatus.

In FIG. 9, an electrostatic latent image is formed on a photosensitive drum 1. A charging roller 2 uniformly charges the photosensitive drum 1. An optical unit 6 scans the photosensitive drum 1 with a laser beam 6. The laser beam 6 is emitted from the optical unit 5. A developing unit 3 develops the electrostatic latent image formed on the photosensitive drum 1 by the laser beam 6, using a toner.

A transfer roller 4 transfers the toner image formed on the photosensitive drum 1 onto a predetermined sheet. A fixing unit 7 fuses and fixes the toner on the sheet. Printing sheets are mounted in a standard cassette 8. A standard-cassette sheet feeding roller 9 picks up a sheet from the standard cassette 8.

There are also shown a manual sheet insertion tray 10, and a manually-inserted-sheet feeding roller 11. Discharging rollers 12 discharge the sheet to the outside of the printer. A registration sensor 13 performs registration of the leading edge of the sheet for printing by detecting the leading edge of the conveyed sheet. A discharged-sheet sensor 14 confirms that the sheet has normally been discharged through the fixing unit 7. A sensor 15 detects the presence/absence of sheets in the standard cassette 8. A sensor 16 detects the presence/absence of sheets for manual insertion. A process cartridge 17 includes the photosensitive drum 1, the charging roller 2 and the developing unit 3, and is detachable relative to the main body of the printer. The sheet after printing is discharged onto a discharged-sheet tray 18.

Each of these units operates according to an instruction from an engine control unit (to be described later). The engine control unit also performs printing processing by controlling the units based on instructions from a printer controller (to be described later).

The process cartridge 17 is usually used in order to facilitate maintenance of the printer. It has been proposed to provide a nonvolatile memory within the process cartridge 17, and write data relating to the state of use of the process cartridge 17 and other data in the nonvolatile memory, for example, in order to control the life of the photosensitive drum 1 included in the process cartridge 17.

FIG. 10 is a block diagram illustrating an example of control units of the printer.

In FIG. 10, a printer controller 101 performs communication with a host computer, develops received image data into information that can be printed by the printer, and exchanges signals with an engine control unit 102. The engine control unit 102 controls the respective units within the printer by means of serial communication.

A sheet-conveyance control unit 103 executes feeding and conveyance of the printing sheet from each sheet feeding unit (or sheet feeding tray) to the discharged-sheet tray 18, based on instructions from the engine control unit 102. An optical-system control unit 104 executes driving of a scanner motor for scanning the photosensitive drum 1 by the laser beam 6, and on/off control of the laser beam 6, based on instructions from the engine control unit 102. A high-voltage-system control unit 105 provides high-voltage outputs necessary for an electrophotographic process, such as charging, development, transfer and the like, based on instructions from the engine control unit 102.

A fixing-temperature control unit 106 performs temperature control of the fixing unit 7 based on an instruction from the engine control unit 102, detection of abnormality in the fixing unit 7, and the like, based on instructions from the engine control unit 102. A sheet-sensor input unit 107 transmits information from sheet sensors within the sheet feeding units (the cassette and the tray) and a sheet conveying path to the engine control unit 102. A jam detection unit 108 detects a failure during sheet conveyance. A failure detection unit 109 detects a failure within the printer. A process cartridge in which, as shown in FIG. 10, a nonvolatile memory 111 capable of exchanging data with the engine control unit 102 is mounted, and data can be read from and written into the engine control unit 102 has also been proposed as the process cartridge 17.

In the above-described configuration, the following approach may be considered as an approach for accessing the nonvolatile memory 111 from the printer controller 101.

The engine control unit 102 performs the processing of reading the entire contents of the nonvolatile memory 111 with a predetermined timing, and storing the read contents into a memory (not shown) within the engine control unit 102. When the engine control unit 102 is requested the contents of the nonvolatile memory 111 from the printer controller 101, the contents which have been read from the nonvolatile memory 111 and stored in the memory within the engine control unit 102 are transmitted to the printer controller 101.

FIG. 11 illustrates a protocol for such processing in the form of a timing chart.

A /SCLK signal is a clock signal for synchronism of serial communication output from the printer controller 101 to the engine control unit 102. A /SC signal is a command/status signal output/responded in synchronization with the clock signal for synchronism. A command is instruction information output from the printer controller 101 to the engine controller 102. A status is status information relating to the engine control unit 102 transmitted from the engine control unit 102 in response to the command from the printer controller 101.

Upon reception of a command 120 to request reading of memory contents A from the printer controller 101, the engine control unit 102 instantaneously transmits information relating to the memory contents A read in advance from the nonvolatile memory 111 and stored in the memory of the engine control unit 102, as status data 121.

However, since the above-described approach is specified such that the engine control unit 102 instantaneously responds to a request of reading/writing of the contents of the memory 111 from the printer controller 101, the engine control unit 102 must acquire in advance the entire contents of the nonvolatile memory 111 and store the acquired contents in the memory provided in the engine control unit 102.

Accordingly, the engine control unit 102 must have a surplus memory capacity covering the capacity of the nonvolatile memory 111. If information to be stored in the nonvolatile memory 111 increases, not only the memory capacity of the nonvolatile memory 111 but also the memory capacity of the engine control unit 102 must be increased, resulting in an increase in the cost of the apparatus.

Particularly if a cartridge mounting a nonvolatile memory whose capacity is larger than the capacity of the memory incorporated in the engine control unit 102 appears in the future, there is the possibility that the cartridge 17 cannot be normally utilized if the capacity of the memory of the engine control unit 102 cannot be increased.

SUMMARY OF THE INVENTION

It is an object of the present invention to provide an image forming apparatus in which a detachable unit mounting a memory is mountable in a main body of the apparatus, and in which the capacity of a memory mounted in the main body of the apparatus can be smaller than the capacity of the memory mounted in the detachable unit.

It is another object of the present invention to provide an image forming apparatus which provides a new protocol for accessing a nonvolatile memory from a printer controller.

According to one aspect, the present invention which achieves these objectives relates to an image forming apparatus mountable a detachable functional unit including storage means. The apparatus includes access-request provision means for providing a request of an access relating to reading or writing of data from or into the storage means, and access means for detecting the request of the access and for performing an access corresponding to the request of the access with respect to the storage means. The access means notifies the access-request provision means of completion of the access. Upon reception of the notification, the access-request provision means detects the completion of the access of the access means, and provides the access means with a request of transmission of a result of the access when the request of the access is reading of data from the storage means. The access means transmits the result of the access in response to the request of transmission of the result of the access.

According to another aspect, the present invention which achieves these objectives relates to a storage medium storing a control program for an image forming apparatus mountable a detachable functional unit including storage means. The control program includes an access-request provision program for providing a request of an access with respect to the storage means, and an access program for detecting the request of the access and for performing an access corresponding to the request of the access with respect to the storage means. The access-request provision program detects completion of the access of the access program, and provides the access program with a request of transmission of a result of the access when the request of the access is reading of data from the storage means. The access program transmits the result of the access in response to the request of transmission of the result of the access.

The foregoing and other objects, advantages and features of the present invention will become more apparent from the following description of the preferred embodiments taken in conjunction with the accompanying drawings.

BRIEF DESCRIPTION OF THE DRAWINGS

FIGS. 4A–4D and 5A–5D are diagrams illustrating commands and statuses used in memory access operations in the first embodiment;

FIG. 7 is a diagram illustrating a command and statuses used in a memory access operation in the second embodiment;

FIGS. 12A and 12B are diagrams illustrating commands and statuses used in a memory access operation in the first embodiment.

DESCRIPTION OF THE PREFERRED EMBODIMENTS

Preferred embodiments of the present invention will now be described in detail.

First Embodiment

Figure 1:
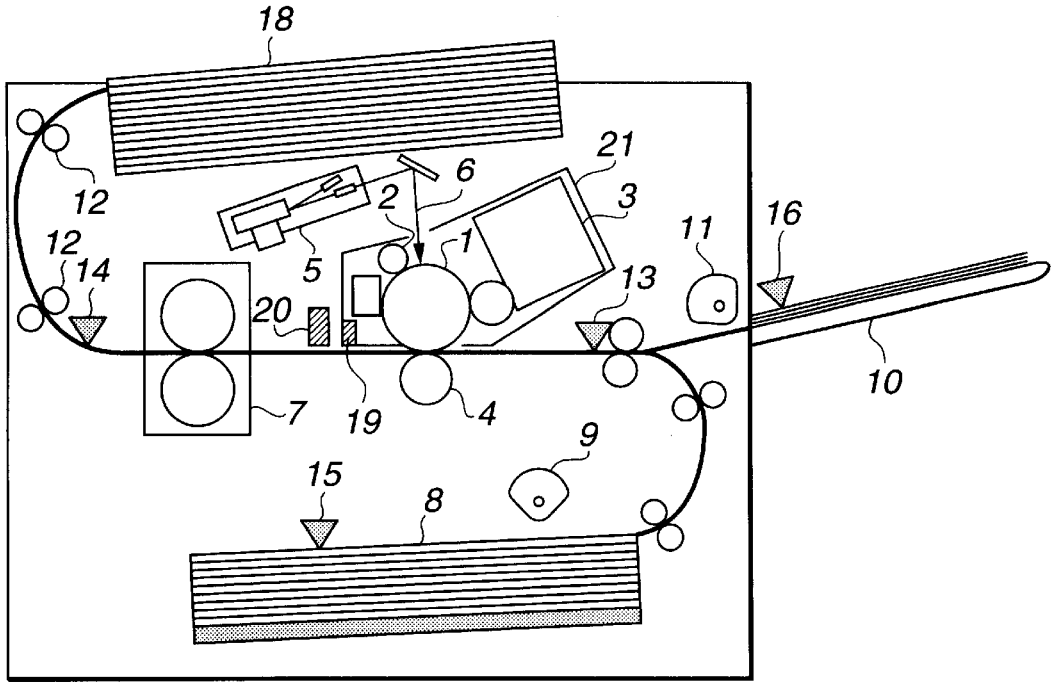
FIG. 1 is a cross-sectional view illustrating the configuration of an image forming apparatus according to a first embodiment of the present invention.
Figure 9:
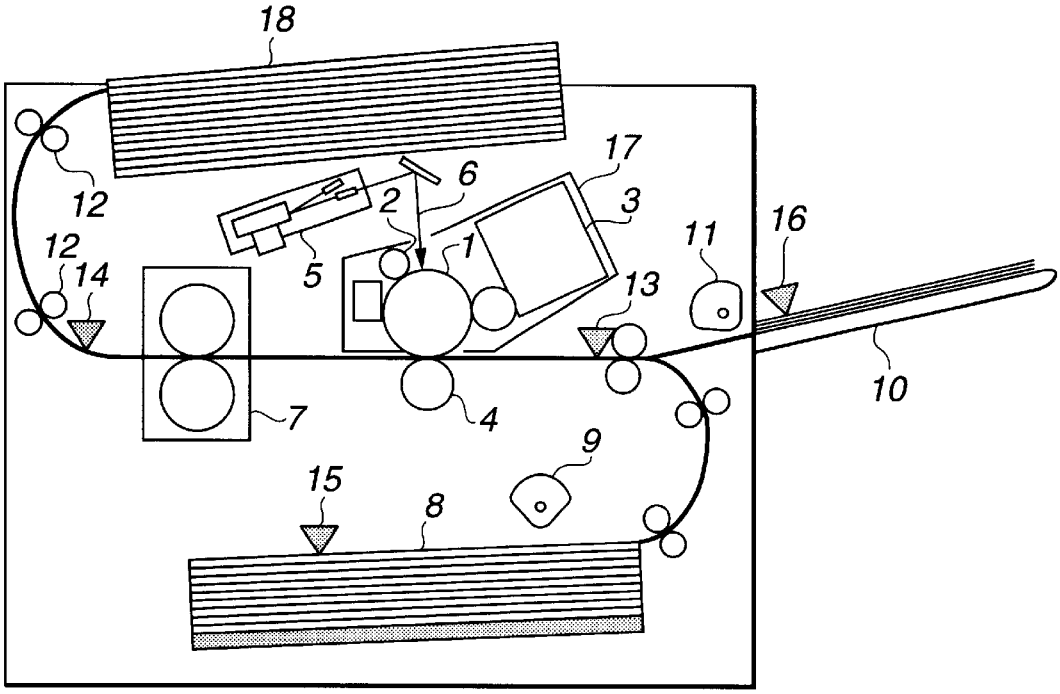
FIG. 9 is a cross-sectional view illustrating a configuration of an electrophotographic printer.

FIG. 1 is a cross-sectional view illustrating the configuration of an image forming apparatus according to a first embodiment of the present invention. FIG. 1 illustrates the configuration of an electrophotographic printer, serving as the image forming apparatus. In FIG. 1, the same components as those shown in FIG. 9 are indicated by the same reference numerals, and further description thereof will be omitted.

In FIG. 1, a process cartridge 21 includes a photosensitive drum 1, a charging roller 2, a developing unit 3 and a nonvolatile memory 19, and is detachably mountable with respect to the main body of the printer. A nonvolatile memory 19 is mounted within the process cartridge 21, and stores, for example, information relating to the photosensitive drum 1 within the cartridge 21 and the quantity of a toner within the developing unit 3. Data relating to the amount of consumption of the toner, and the like are written from an engine control unit 202 (see FIG. 2) into the nonvolatile memory 19. Memory access means 20 is also provided. The engine control unit 202 accesses the nonvolatile memory 19 via the memory access means 20 with a predetermined timing or in accordance with a request for reading or a request for writing from a printer controller 201 (see FIG. 2).

Figure 2:
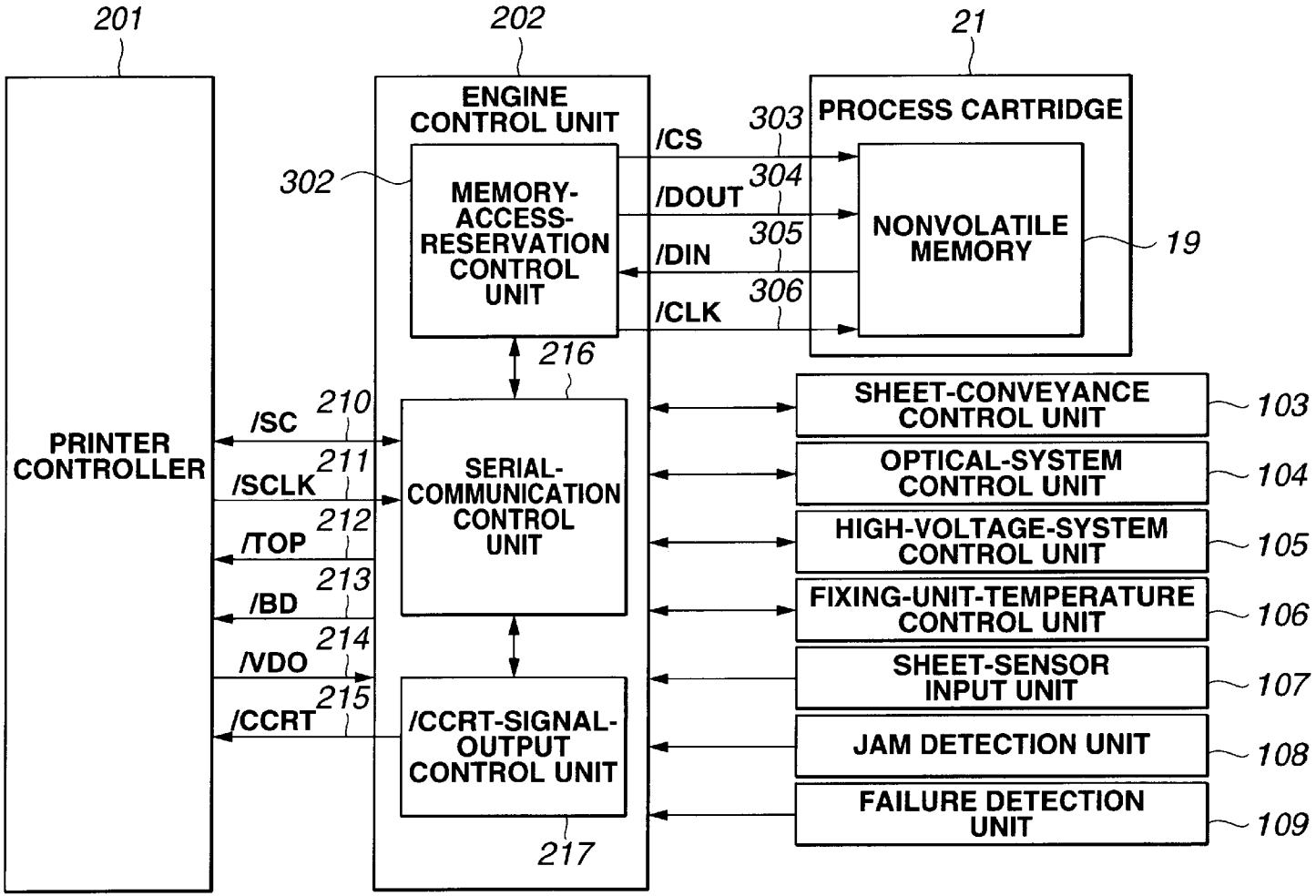
FIG. 2 is a block diagram illustrating a configuration of a control circuit of the image forming apparatus shown in FIG. 1.

FIG. 2 is a block diagram illustrating the configuration of a control unit of the printer in the first embodiment.

Figure 10:
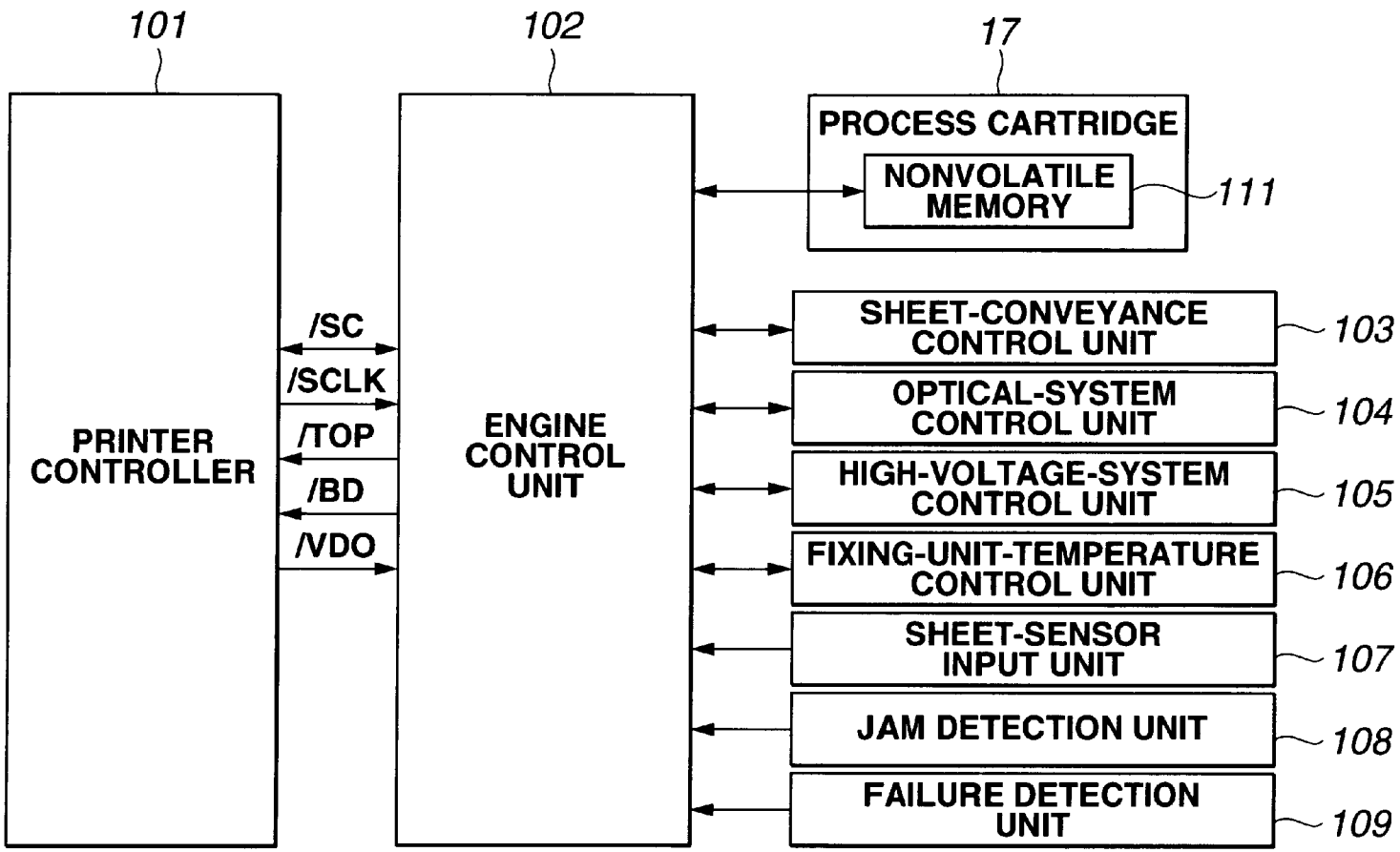
FIG. 10 is a block diagram illustrating a control circuit of the electrophotographic printer shown in FIG. 9.
Figure 11:
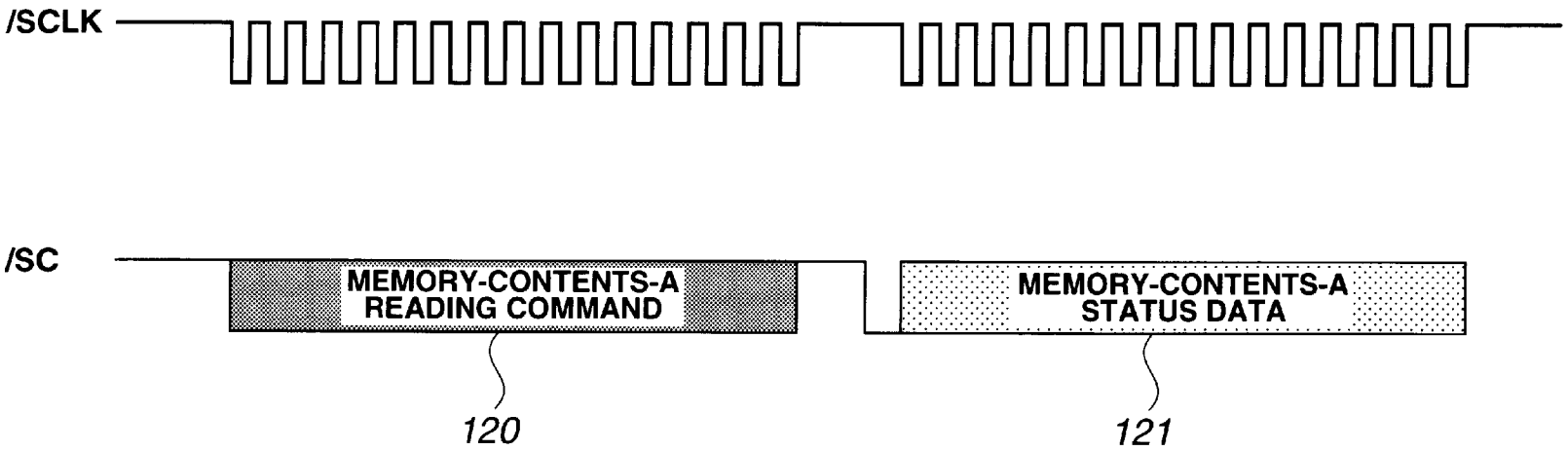
FIG. 11 is a timing chart illustrating memory-information acquiring processing.

In FIG. 2, the same components as those shown in FIG. 10 are indicated by the same reference numerals, and further description thereof will be omitted.

In FIG. 2, a printer controller 201 performs communication with a host computer, develops image data received from the host computer into information that can be printed by the printer, and exchanges signals with the engine control unit 202. The engine control unit 102 exchanges signals with the printer controller 201, and controls the respective units within the printer by means of serial communication.

A memory-access-reservation control unit 302 is provided within the engine control unit 202, and performs reading/ writing of data with respect to the nonvolatile memory 19 within the process cartridge 21. The memory-access-reservation control unit 302 corresponds to the memory access means 20 in FIG. 1.

Next, a description will be provided of signals between the printer controller 201 and the engine control unit 202.

A serial-communication control unit 216 performs control of receiving and analyzing commands transmitted from the printer controller 201 in the forms of /SC and /SCLK signals (to be described later), and transmitting necessary status information. A /CCRT-signal-output control unit 217 outputs a /CCRT signal 215 in order to notify the occurrence of a change in a state (such as the presence/absence of sheets, occurrence of a jam, occurrence of a failure, or the like) within the printer from the engine control unit 202 to the printer controller 201 when such a change has occurred.

The /CCRT signal is also used in order to notifying completion of preparation of memory information (to be described later).

Reference numeral 210 represents a serial data (/SC) signal in serial communication performed between the printer controller 201 and the engine control unit 202. This signal includes a command output from the printer controller 201 and a status output from the engine control unit 202. A /SCLK signal 211 is a synchronizing clock signal in serial communication, and is output from the printer controller 201 to the engine control unit 202.

A /TOP signal 212 is a vertical synchronizing signal indicating the start of transmission of an image signal when the position of the sheet reaches an image writing position after conveyance of the sheet. A /BD signal 213 is a horizontal synchronizing signal for obtaining synchronism of an image in a main scanning direction. A /VDO signal 214 is an image signal.

The Operation of a Serial-Communication Control Unit

Upon reception of a command to request reading of the contents of the memory for confirming the contents of the nonvolatile memory 19 within the process cartridge 21 from the printer controller 201, a serial-communication control unit 216 requests the memory-access-reservation control unit 302 to read the contents of the memory, and transmits a status indicating that reservation of reading has been set.

Upon reception of notification of the completion of reading of the contents of the nonvolatile memory 19 within the process cartridge 21, the memory-access-reservation control unit 302 provides a /CCRT-signal-output control unit 217 with information in order to notify the printer controller 201 of the completion of preparation of memory information using a /CCRT signal. In response to this information, the /CCRT-signal-output control unit 217 outputs a /CCRT signal to the printer controller 201. Upon reception of a request to write the contents of the nonvolatile memory 19 within the process cartridge 21, the memory-access-reservation control unit 302 notifies the completion of writing processing also using a /CCRT signal.

Upon reception of the /CCRT signal, the printer controller 201 transmits a command to the serial-communication control unit 216, and transmits a data request command after confirming that the engine control unit 202 has completed preparation of the transmission of information relating to the nonvolatile memory 19. The serial-communication control unit 216 stores data read from the nonvolatile memory 19, and transmits the stored data as a status response to the data request command. Thus, the printer controller 201 can access the nonvolatile memory 19 within the process cartridge 21. This series of operations will be described in detail later.

Memory-Access-Reservation Control Unit

Next, a description will be provided of communication between the memory-access-reservation control unit 302 and the nonvolatile memory 19.

A chip select signal (/CS signal) 303 is output from the memory-access-reservation control unit 302 to the nonvolatile memory 19. A serial command signal (/DOUT signal) 304 is output from the memory-access-reservation control unit 302 to the nonvolatile memory 19. A data signal (/DIN signal) 305 is transmitted from the nonvolatile memory 19 to the memory-access-reservation control unit 302. A serial synchronizing clock signal (/CLK signal) 306 is output from the memory-access-reservation control unit 302 to the nonvolatile memory 19.

The main body of the printer and the process cartridge 21 are electrically interconnected via a connector. By mounting the cartridge 21 in the main body of the printer, the connector at the main body of the printer is connected to the connector at the cartridge 21.

Data Communication Processing

Next, operations in the printer controller 201, the engine control unit 202 and the memory-access-reservation control unit 302 when the printer controller 201 accesses information within the nonvolatile memory 19 will be described in detail with reference to the timing charts shown in FIGS. 3A and 3B.

Figure 3A:
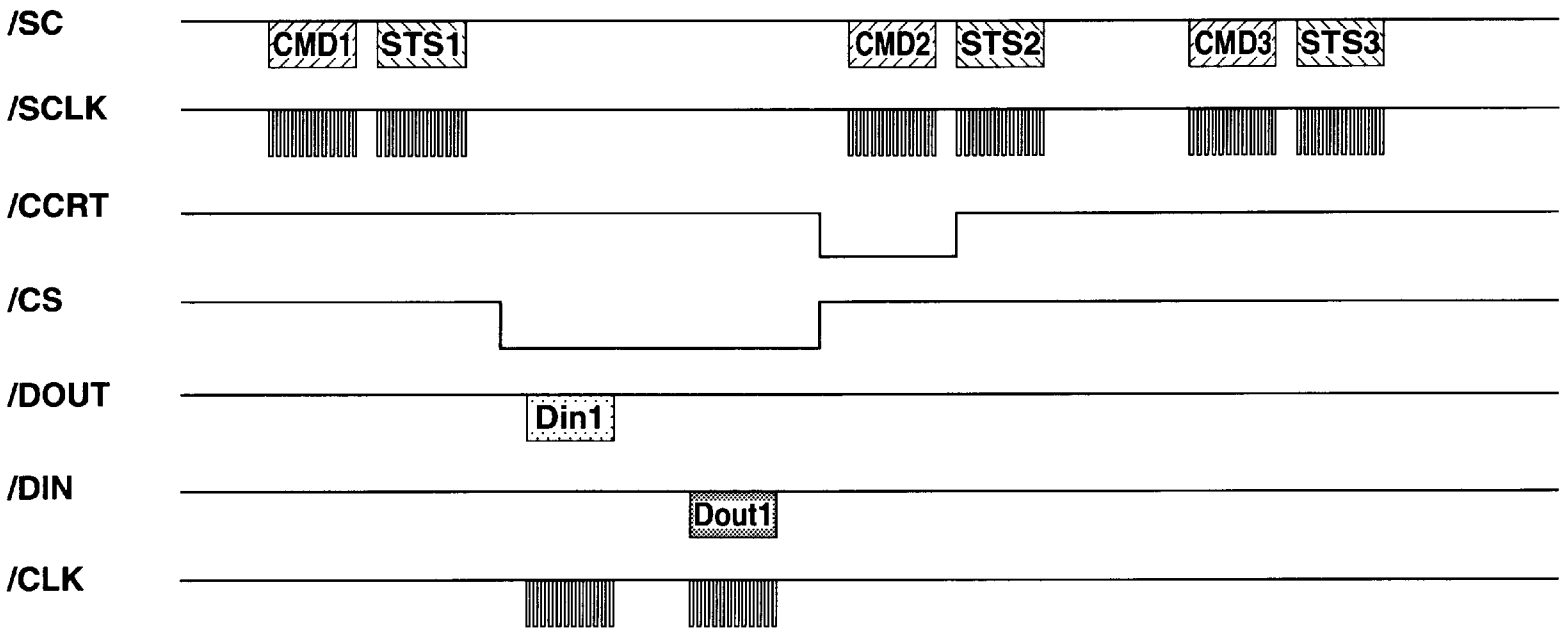
FIGS. 3A and 3B are timing charts, each illustrating a memory access operation in the first embodiment.
Figure 3B:
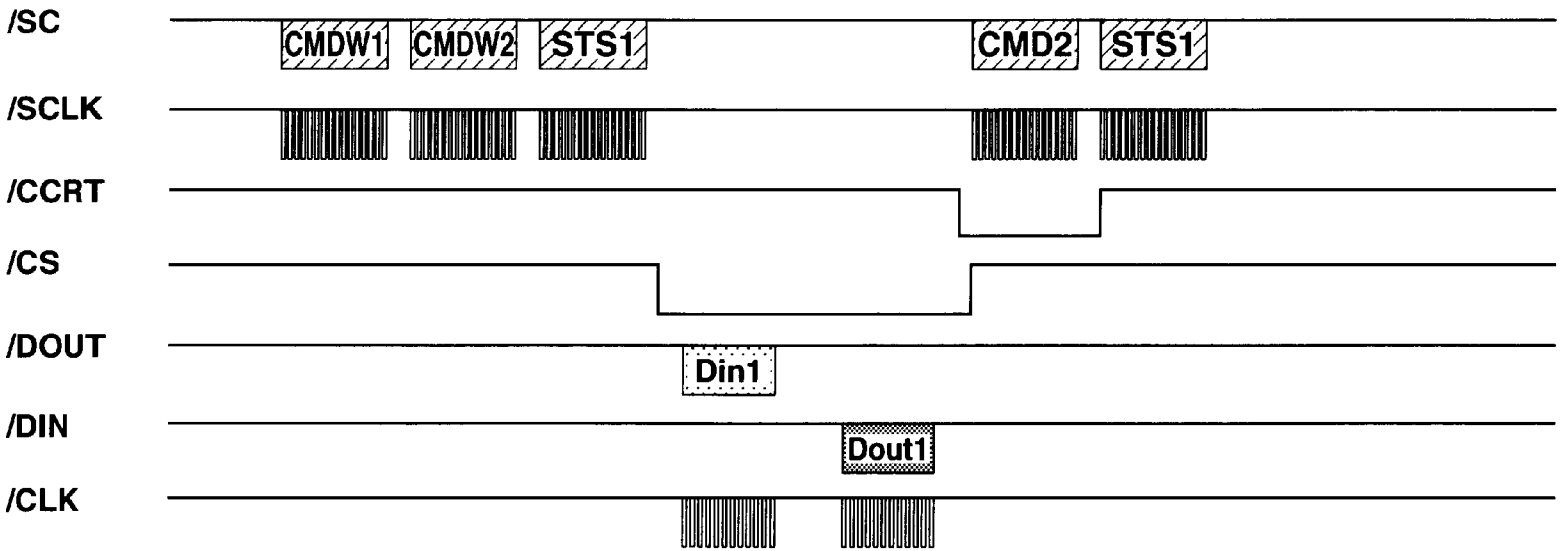

Signals shown in FIGS. 3A and 3B are as described above. /SC and /SCLK signals are signals in serial communication performed between the engine control unit 202 and the printer controller 201. A /CCRT signal is a state-change signal output from the engine control unit 202 to the printer controller 201. /CS, /DOUT, /DIN and /CLK signals are signals in serial communication performed between the engine control unit 202 and the nonvolatile memory 19 within the process cartridge.

FIG. 3A illustrates a reading operation from the nonvolatile memory 19.

First, a command 1 (CMD1) to request reading of data stored in the nonvolatile memory 19 is transmitted from the printer controller 201 to the engine control unit 202 using a /SC signal. The CMD1 has, for example, a configuration as shown in FIG. 4A, and includes read reservation command codes comprising 6 bits from the 2nd bit to the 7th bit, and read memory area codes comprising 8 bits from the 8th bit to the 15th bit assigning areas to be read in the nonvolatile memory 19.

As shown in FIG. 4B, the 8-bit reading memory area codes representing memory areas are set so that addresses of the nonvolatile memory 19 correspond to respective ones of 8-bit codes. By receiving the CMD1, the engine control unit 202 can identify the data of an address of the nonvolatile memory 19 which has been requested to be read. In the following description, it is assumed that an address which has been requested to be read is a 00h address, i.e., the 8th–15th bits constituting the read memory area codes of the CMD1 are all 0.

Upon reception of the CMD1, the engine control unit 202 requests the memory-access-reservation control unit 302 to read the contents of the memory, and immediately transmits a status 1 (STS1) to the printer controller 201 using the serial communication control unit 216. The STS1 has, for example, a configuration as shown in FIG. 4C. That is, the STS1 is 16-bit data, and indicates in what access state the engine control unit 202 (the memory-access-reservation control unit 302) is with respect to nonvolatile memory 19, by memory access state codes comprising 3 bits from the 2nd bit to the 4th bit. FIG. 4D illustrates an example of memory access state codes. In this case, the engine control unit 202 sets the memory access state code of the STS1 responding to the CMD1 to an "in reading from memory" state (setting the 2nd–4th bits to "001"), and sets and transmits the read memory area code (00h) of the received CMD1 for the 8–15th bits.

When reading from the memory has been reserved and the transmission of the STS1 has been completed, the memory-access-reservation control unit 302 performs the processing of reading data from the nonvolatile memory 19 within the process cartridge 21.

First, a memory accessible state is provided by making the chip select (/CS) signal "true" (="low"). Then, Din1, serving as a data reading command for the address 00h is transmitted in synchronization with the serial synchronizing clock signal (/CLK). Then, data Dout1 of the address 00h output from the memory in synchronization with the serial synchronizing clock signal is read. At that time, the preparation of data of the memory address 00h requested from the printer controller 201 using the CMD1 is completed.

Upon completion of the preparation of the data, the memory-access-reservation control unit 302 notifies the serial-communication control unit 216 of the completion. In response to this notification, the serial-communication control unit 216 rewrites the memory access state codes comprising the 2nd–4th bits of the STS1 held within the serial-communication control unit 216 into a code indicating "data accessible" ("000" shown in FIG. 4D), and sets the 2nd bit (change in STS1 state present) of an engine state change status (STS2) having the configuration shown in FIG. 5A. By supplying the /CCRT-output control unit 217 with this bit set, the /CCRT-signal-output control unit 217 makes the /CCRT signal "true" (="low").

The printer controller 201 recognizes the generation of a change in the state of the engine control unit 202 by knowing that the /CCRT signal assumes "true", provides a CMD2, serving as an engine-state-change status (STS2) request command having, for example, a configuration as shown in FIG. 5B, and reads the status STS2 transmitted from the engine control unit 202. The printer controller 201 recognizes that there is a change in the state of the STS1 by knowing that the 2nd bit of the STS2 is set. Since the preceding state of the STS1 is "in reading from memory", it is recognized that the reading from the memory would have been completed.

After receiving the STS2, the printer controller 201 transmits a data request command (CMD3) having, for example, a configuration as shown in FIG. 5C. The CMD3 is a data request command comprising 15 bits from the 1st bit to the 15th bit and containing address information. Upon reception of the CMD3, the serial-communication control unit 216 stores the result of reading (the contents of address 00h) including the read address (00h) information in a status response STS3 for the CMD3, and transmits the stored data. The STS3 has, for example, a configuration as shown in FIG. 5D, in which the address information and the result of reading are stored in 14 bits from the 2nd bit to the 15th bit. A series of processing for reading is performed in the above-described manner.

FIG. 3B illustrates a writing operation into the nonvolatile memory 19.

Writing processing is performed using commands for writing CMDW1 and CMDW2 shown in FIGS. 12A and 12B, respectively, and the above-described STS1.

First, upon reception of the write command CMDW1 shown in FIG. 12A from the printer controller 201, the engine control unit 202 recognizes that the succeeding code is data to be written. In the command CMDW2 transmitted after the CMDW1, 8-bit data to be written in memory areas indicated by the 8th–15th bits of the command CMDW1 are assigned in the 2nd–9th bits. Upon reception of these series of commands, the engine control unit 202 sets the STS1 to a state of "in writing in the memory", and transmits the STS1 to the printer controller 201.

Then, the memory-access-reservation control unit 302 performs a writing operation for the nonvolatile memory 19. Upon completion of the writing operation, the memory access state code of the STS1 changes into an "accessible" state, and the 2nd bit of the STS2 is set. In response to this state, a /CCRT signal is output from the /CCRT-signal-output control unit 217, and the printer controller 201 transmits a command to request an STS2.

The printer controller 201 confirms the 2nd bit of the transmitted STS2, and recognizes that the sate of the STS1 has changed, i.e., data has normally been written in the memory. Thus, the writing operation is completed.

In contrast to the reading operation, in the writing operation, since writing data is also transmitted when requesting writing, exchange of a CMD3 and an STS3 in response to the CMD3 is not performed.

As described above, according to the first embodiment, only necessary data is read or written in accordance with a request from the printer controller 201, the engine control unit 202 is only necessary to mount a memory whose capacity is much smaller than the capacity of the nonvolatile memory 19. Hence the cost of the image forming apparatus can be reduced. Even if the capacity of the nonvolatile memory 19 mounted in the process cartridge 21 increases, the memory of the main body of the apparatus need not be increased.

In the first embodiment, a description has been provided of the case in which the engine control unit 202 accesses the nonvolatile memory 19 in response to a request from the printer controller 201. However, the engine control unit 202 sometimes performs a reading or writing operation with respect to the nonvolatile memory 19 under the unit's particular conditions without an instruction from the printer controller 201.

In such a case, a memory access request command from the printer controller 201 is sometimes received during a memory access under the particular conditions of the engine control unit 202. In such a case, the following two approaches may be considered:

1. An approach in which an access state is reflected according to the 2nd–4th bit codes even during a memory access based on a particular request of the engine control unit 202, and the state is notified to the printer controller 201.
2. An approach in which the STS1 is set to an accessible state even during a memory access based on a particular request of the engine control unit 202, and a request from the printer controller 201 is accepted. Upon completion of the access to the memory based on the particular request of the engine control unit 202, an access to the nonvolatile memory 19 based the request from the printer controller 201 is executed, and that state is reflected on the STS1.

The present invention may be applied to any one of these approaches, without impairing the effects of the invention.

In the first embodiment, the /CCRT signal is not active when the printer controller 201 issues the request for readout from the memory 19 or for writing into the memory 19, although the status of STS1 is transits from the "accessible" state to the "in reading from memory" or the "in writing in the memory" state.

However, It can be structured that the /CCRT signal becomes active in response to the above-described transition of the state of STS1. In this structure, the controller 201 can recognize that the request for accessing the memory is accepted by the engine control unit 202.

Second Embodiment

In the first embodiment, a description has been provided of the case in which an access to the nonvolatile memory 19 is performed only based on a request from the printer controller 201. A second embodiment of the present invention has a feature of capable of being applied not only to a case in which a reading or writing operation with respect to the nonvolatile memory 19 is performed according to an instruction from the printer controller 201, but also to a case in which the engine controller 202 accesses the nonvolatile memory 19 independent of the printer controller 201.

Figure 6:
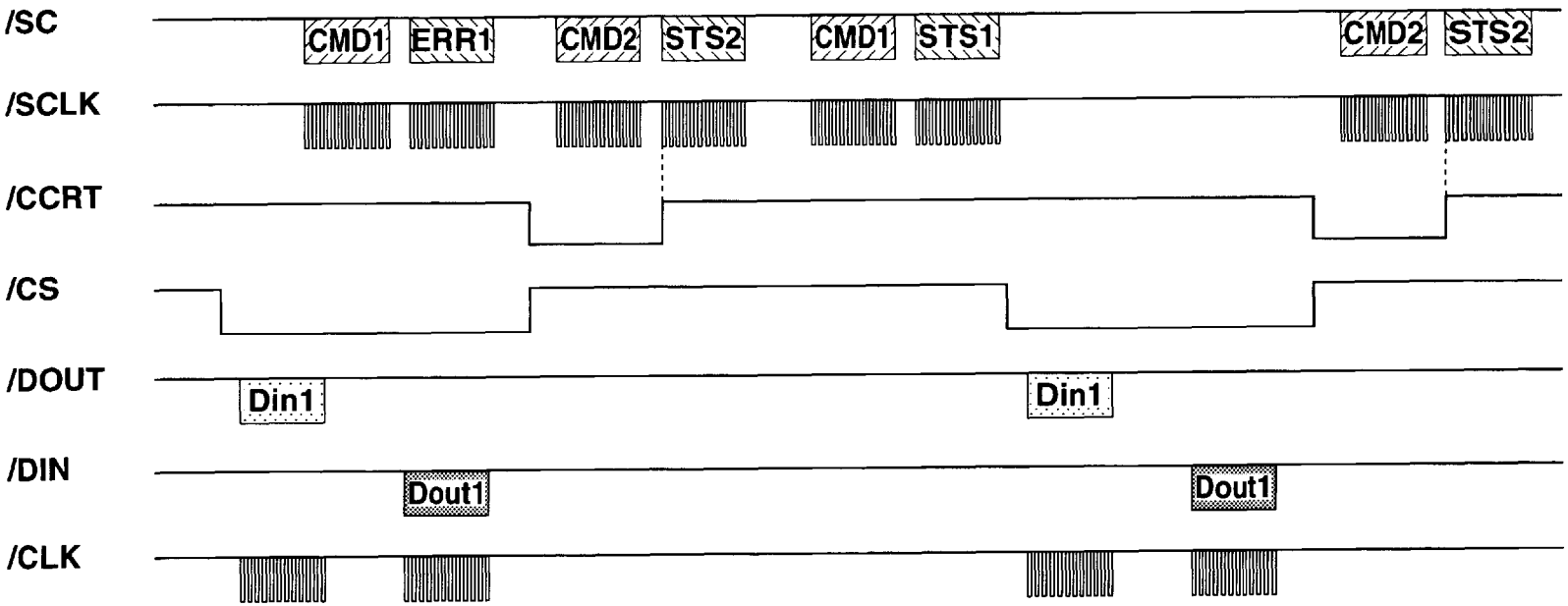
FIG. 6 is a timing chart illustrating a memory access operation in a second embodiment of the present invention.

FIG. 6 is a timing chart represented in the same manner as FIG. 3 in the first embodiment, and illustrates processing in which, while the engine control unit 202 (the memory-access-reservation control unit 302) accesses address 00h of the nonvolatile memory 19 within the process cartridge 21, a request to read another address is received from the printer controller 201. In the second embodiment, commands, status responses and the like exchanged between the printer controller 201 and the engine control unit 202 are the same as those in the first embodiment, except for memory access state codes of the STS1. Hence, further description of the structures of the same portions will be omitted. In the second embodiment, as shown in FIG. 7, a code ("111") indicating that the engine control unit 202 performs memory access is added to the memory access state codes.

There is a case in which the engine control unit 202 accesses the nonvolatile memory 19 within the process cartridge 21 without an instruction from the printer controller 201 for some reason. In such a case, the engine control unit 202 sets the memory access state code of the STS1 to an "in engine access" state ("111"), sets the code of an address of the nonvolatile memory 19 to be independently accessed by the engine control unit 202 in the reading memory area codes (the 8th–15th bits), and requests the memory-access-reservation control unit 217 to access the nonvolatile memory 19.

When a memory access request command CMD1 (see FIG. 4A) is received from the printer controller 201 while accessing the nonvolatile memory 19 according to an request of the engine control unit 202, the serial-communication control unit 216 transmits an error code (a non-executable error generation status) EER1 as a status. When the memory-access-reservation control unit 217 thereafter detects the completion of the memory access, the serial-communication control unit 216 notifies the /CCRT-signal-output control unit 217 of the fact, and the /CCRT-signal-output control unit 217 outputs a /CCRT signal.

When the printer controller 201 has recognized this /CCRT signal, the printer controller 201 determines that a memory accessible state is provided, so that the printer controller 201 can transmit a memory access request command (CMD1) as that described in the first embodiment and execute a request for reading or writing from or into the memory. That is, in FIG. 6, the same processing as in the first embodiment is performed from the second transmission of the CMD1.

In the second embodiment, the processing of transmitting an error status in response to the first CMD1 is performed. However, it is also possible to notify the engine control unit 202 of the fact that the printer controller 201 is currently not in a state of capable of accepting a request for a memory access.

Third Embodiment

In the above-described first and second embodiments, there is a request for reading or writing of memory information from the printer controller 201, and after receiving the request as a reservation, the engine control unit 202 notifies the printer controller 201 of the fact that data has been prepared using a /CCRT signal when the engine control unit 202 has accessed the memory and the data access has been completed. However, a third embodiment of the present invention has the feature that the above-described notification to the printer controller 201 using the /CCRT signal is omitted by periodically checking the STS1 of the engine control unit 202 from the printer controller 201.

This is because if the printer controller 201 has a function of periodically reading the STS1, whether or not the engine control unit 202 has completed a memory access from the state of "in memory access" and changed to an accessible state can be recognized by monitoring memory access state codes of the STS1.

Figure 8:
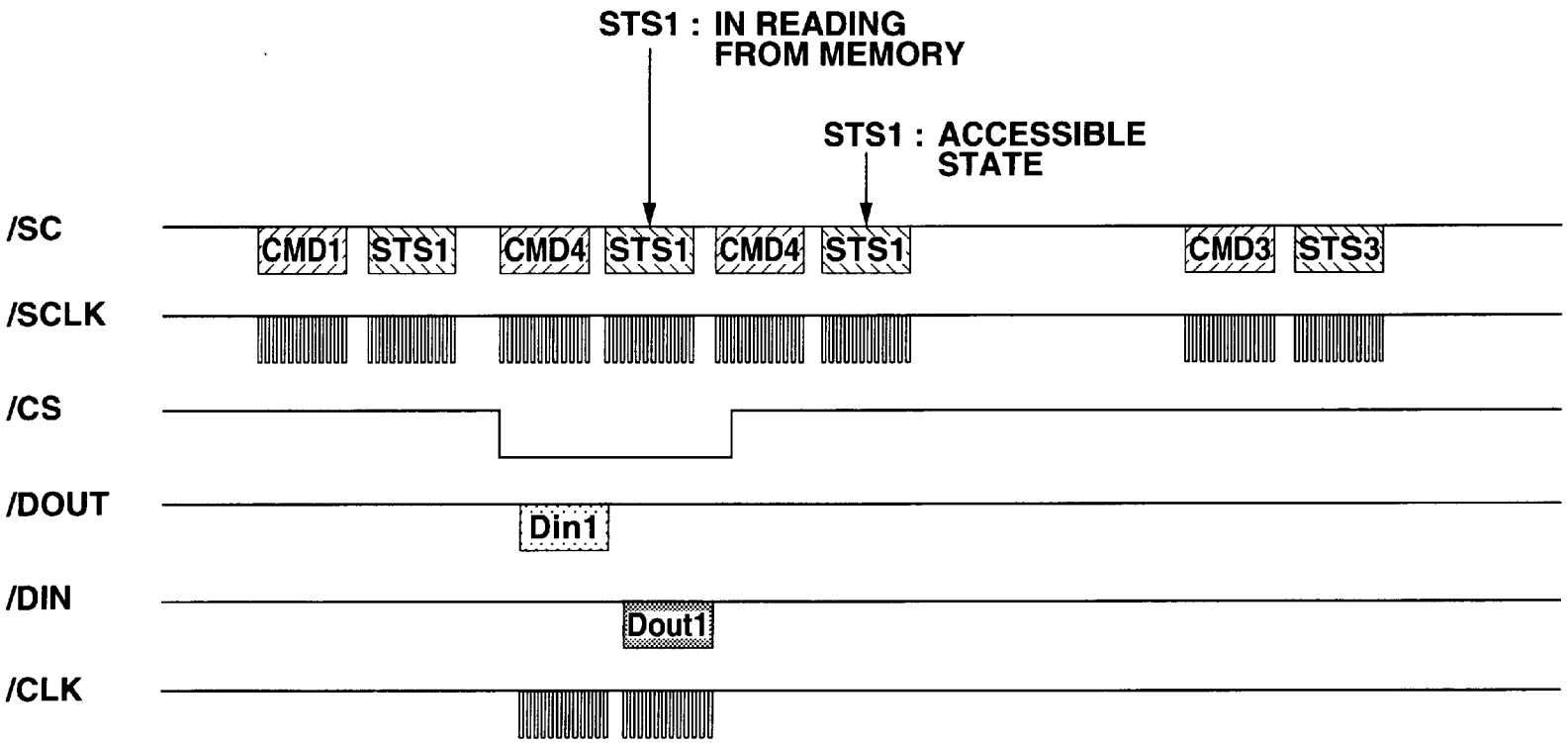
FIG. 8 is a timing chart illustrating a memory access operation in a third embodiment of the present invention.

FIG. 8 is a timing chart when performing the same reading processing as that in the first embodiment without using a /CCRT signal. Since respective signals in FIG. 8 are the same as those in FIG. 3 or 6, further description thereof will be omitted.

The same processing as in the first embodiment is performed from transmitting a memory reading request command CMD1 from the printer controller 201 to performing a status response STS1 for the transmitted command by the engine control unit 201. However, if an STS1 in which the memory access state code is "in reading from the memory" is received, the printer controller 201 periodically transmits a command CMD4 to request the STS1 without awaiting reception of a /CCRT signal.

FIG. 8 illustrates a state in which, although the memory access state code of the status response STS1 for the first CMD4 remains to be "in reading from the memory", the memory access state code of the STS1 responded to the second CMD4 has changed to an "accessible state".

The printer controller 201 detects the memory access state in the engine control unit 202 in the above-described manner, and performs the processing of transmitting a CMD3 and receiving an STS3 as in the first embodiment when it has been detected that the state has changed to an accessible state.

Thus, by reading the STS1 whenever necessary and reading the memory access state code, the printer controller 201 can recognize a change from an "in reading from the memory" state to a "memory accessible" state without using a /CCRT signal.

Other Embodiments

Although in the foregoing embodiments, the nonvolatile memory within the cartridge and the engine control unit are interconnected using an electrical connector, any other appropriate connection, such as a non-contact-type connection utilizing electromagnetic coupling, may also be adopted.

Although in the foregoing embodiments, a description has been provided of the process cartridge as a detachable unit, the present invention is not limited to the process cartridge. Any other appropriate detachable unit mounting a nonvolatile memory and connectable to the main body of an image forming apparatus so as to be able to perform communication with the main body, for example, a consumable unit or a periodically exchangeable unit, such as a toner cartridge, a fixing unit, a developing unit, a sheet feeding cassette, a sheet feeding roller or the like, or each type of optional unit, such as a sorter, a duplex printing mechanism or the like, connected to the image forming apparatus may also be used.

The present invention may be applied to a system comprising a plurality of apparatuses (such as a host computer, an interface apparatus, a reader, a printer and the like), or to an apparatus comprising a single unit (such as a copier, a facsimile apparatus or the like).

The objects of the present invention may, of course, also be achieved by supplying a system or an apparatus with a storage medium (or a recording medium) storing program codes of software for realizing the functions of the above-described embodiments, and reading and executing the program codes stored in the storage medium by means of a computer (or a CPU (central processing unit) or an MPU (microprocessor unit)) of the system or the apparatus. In such a case, the program codes themselves read from the storage medium realize the functions of the above-described embodiments, so that the storage medium storing the program codes constitute the present invention. The present invention may, of course, be applied not only to a case in which the functions of the above-described embodiments are realized by executing program codes read by a computer, but also to a case in which an OS (operating system) or the like operating in a computer executes a part or the entirety of actual processing, and the functions of the above-described embodiments are realized by the processing.

The present invention may, of course, be applied to a case in which, after writing program codes read from a storage medium into a memory provided in a function expanding card inserted into a computer or in a function expanding unit connected to the computer, a CPU or the like provided in the function expanding card or the function expanding unit performs a part or the entirety of actual processing, and the functions of the above-described embodiments are realized by the processing.

The individual components shown in outline or designated by blocks in the drawings are all well known in the image forming apparatus arts and their specific construction and operation are not critical to the operation or the best mode for carrying out the invention.

While the present invention has been described with respect to what are presently considered to be the preferred embodiments, it is to be understood that the invention is not limited to the disclosed embodiments. To the contrary, the present invention is intended to cover various modifications and equivalent arrangements included within the spirit and scope of the appended claims. The scope of the following claims is to be accorded the broadest interpretation so as to encompass all such modifications and equivalent structure and functions.

What is claimed is:

1. An image forming apparatus on which is mounted a detachable functional unit that includes a storage unit, said apparatus comprising:

an image processing unit adapted to generate dot data corresponding to an image to be formed, based on data from an external apparatus; and an image forming unit adapted to form an image, based on the dot data generated by said image processing unit, wherein said image processing unit is adapted to provide said image forming unit a request for reading out data from the storage unit, wherein said image forming unit is adapted to detect the request, to perform a read-out operation from the storage unit, and to notify said image processing unit of an end of the read-out operation, wherein said image processing unit is adapted to recognize the end of the read-out operation in said image forming unit upon reception of a notification, and to provide said image forming unit with a request for transmission of the data read out from the storage unit, and wherein said image forming unit is adapted to transmit the data read out from the storage unit, in response to the request for transmission.

2. An image forming apparatus according to claim 1, wherein said image forming unit is accessible with respect to the storage unit independently of a request for access from said image processing unit, and is adapted to transmit data indicating incapability of performing an access operation to said image processing unit when the request for access is detected while the storage unit is being independently accessed.

3. An image forming apparatus according to claim 1, wherein said image processing unit is adapted to recognize the end of the read-out operation by detecting the notification from said image forming unit at every predetermined time interval after providing the request for reading out.

4. An image forming apparatus according to claim 1, wherein said image forming apparatus forms an image according to an electrophotographic method, and wherein the functional unit includes any one of a photosensitive member, a toner cartridge, a fixing unit, a transfer unit, a sheet feeding cassette, and a sorter.

5. An image forming apparatus according to claim 1, wherein said image processing unit is adapted to provide said image forming unit with a request for writing data into the storage unit, wherein said image forming unit is adapted to detect the request for writing, to perform a writing operation to the storage unit, and to notify said image processing unit of an end of the writing operation, and wherein said image processing unit is adapted to recognize the end of the writing operation in said image forming unit upon reception of a notification.

6. An image forming apparatus according to claim 5, wherein said image processing unit is adapted to serially transmit command data and data to be written into the storage unit as the request for writing.

7. An image forming apparatus according to claim 1, wherein said image processing unit is adapted to serially transmit command data and address data specifying an area of the storage unit from which data is to be read out as the request for reading out.

8. An image forming apparatus according to claim 1, wherein said image forming unit is adapted to return status data in response to the request for reading out from said image processing unit.

9. An image forming apparatus according to claim 1, wherein said image processing unit is adapted to provide said image forming unit with a request for sending status data representing an access state of the storage unit.

10. An image forming apparatus according to claim 1, wherein said image forming unit is adapted to output a signal, a level of which changes in response to a change of an access state of the storage unit.

11. An image processing apparatus with a function for generating dot data corresponding to an image to be formed, based on data from an external apparatus, and a function for supplying the generated dot data to an image forming unit, on which is mounted a detachable function unit that includes a storage unit, said image processing apparatus comprising:

means for providing the image forming unit with a request for reading out data from the storage unit, wherein the image forming unit is adapted to perform a read-out operation from the storage unit, in response to the request for reading out, and to provide a notification to said image processing apparatus of an end of the read-out operation;

means for recognizing the end of the read-out operation by the image forming unit upon reception of the notification; and means for providing the image forming unit with a request for transmission of the data read out from the storage unit.

12. An image processing apparatus according to claim 11, wherein the image forming unit is accessible with respect to the storage unit independently of a request for access from said image processing apparatus, and is adapted to transmit data indicating incapability of performing an access operation to said image processing apparatus when the request for access is detected while the storage unit is being independent accessed, and wherein said means for recognizing is adapted to recognize incapability of performing the access operation in the image forming unit by detecting the data indicating incapability transmitted from the image forming unit.

13. An image processing apparatus according to claim 11, wherein said means for recognizing is adapted to recognize the end of the read-out operation by detecting the notification from the image forming unit at every predetermined time interval after providing the request for reading out.

14. An image processing apparatus according to claim 11, further comprising means for providing the image forming unit with a request for writing data into the storage unit, wherein the image forming unit is adapted to perform a writing operation to the storage unit in response to the request for writing, and to provide a writing notification to said image processing apparatus of an end of the writing operation, and wherein said means for recognizing is adapted to recognize the end of the writing operation in the image forming unit upon reception of the writing notification.

15. An image processing apparatus according to claim 11, further comprising means for serially transmitting command data and data to be written into the storage unit as the request for writing.

16. An image processing apparatus according to claim 11, further comprising means for serially transmitting command data and address data specifying an area of the storage unit from which data is to be read out as the request for reading out.

17. An image processing unit according to claim 11, further comprising:

means for outputting a signal, a level of which changes in response to a change of an access state of the storage unit, and means for providing the image forming unit with a request for sending status data representing an access state of the storage unit in response to the signal.

18. An image forming apparatus on which is mounted a detachable functional unit that includes a storage unit, said image forming apparatus comprising:

means for receiving dot data, corresponding to an image to be formed, which is generated and transmitted by an image processing unit;

means for forming an image based on the received dot data;

means for receiving a request for reading out from the image processing unit, requesting to read out data from the storage unit;

means for detecting the request for reading out;

means for performing a read-out operation from the storage unit;

means for providing a notification to the image processing unit of an end of the read-out operation, wherein the image processing unit recognizes the end of the read-out operation by said image forming apparatus and provides said image forming apparatus with a request for transmission of data read out from the storage unit; and means for transmitting the data read out from the storage unit in response to the request for transmission.

19. An image forming apparatus according to claim 18, wherein said image forming apparatus is accessible with respect to the storage unit independently of a request for access from the image processing unit, and transmits data indicating incapability of performing an access operation to the image processing unit when the request for access is detected while the storage unit is being independently accessed.

20. An image forming apparatus according to claim 18, wherein said image forming apparatus forms an image according to an electrophotographic method, and wherein the functional unit includes any one of a photosensitive member, a toner cartridge, a fixing unit, a transfer unit, a sheet feeding cassette, and a sorter.

21. An image forming apparatus according to claim 18, further comprising:

means for detecting a request for writing data into the storage unit provided by the image processing unit;

means for performing a writing operation to the storage unit; and means for notifying the image processing unit of an end of the writing operation.

22. An image forming apparatus according to claim 18, wherein said image forming unit is adapted to receive a command data and data to be written into said storage unit serially transmitted from said image processing unit as the request for writing.

23. An image forming apparatus according to claim 18, wherein said means for receiving is adapted to receive command data and address data specifying an area of the storage unit from which data is to be read out, serially transmitted from the image processing unit as the request for reading out.

24. An image forming apparatus according to claim 18, further comprising means for returning status data in response to the request from the image processing unit.

25. An image forming apparatus according to claim 18, further comprising means for outputting a signal, a level of which changes in response to a change of an access state of the storage unit.

* * * * *

UNITED STATES PATENT AND TRADEMARK OFFICE

CERTIFICATE OF CORRECTION

PATENT NO. : 6,634,817 B2
DATED : October 21, 2003
INVENTOR(S) : Yoji Serizawa

It is certified that error appears in the above-identified patent and that said Letters Patent is hereby corrected as shown below:

Column 3,
Line 24, “mountable” should read -- mountable with --.
Lines 42-43, “mountable” should read -- mountable with --.

Column 9,
Line 1, “It” should read -- it --.
Line 10, “capable of being applied” should read -- being capable of applying --.
Line 66, “of capable” should read -- of being capable --.

Column 13,
Line 19, “independent” should read -- independently --.
Line 50, “unit” should read -- apparatus --.

Signed and Sealed this

Thirteenth Day of January, 2004

JON W. DUDAS
*Acting Director of the United States Patent and Trademark Office*